US008895822B2

(12) United States Patent
Fujii

(10) Patent No.: US 8,895,822 B2
(45) Date of Patent: Nov. 25, 2014

(54) ACTION FOR UPRIGHT PIANO

(75) Inventor: Yukimitsu Fujii, Kagoshima (JP)

(73) Assignee: Yugen Kaisha Fuji Piano Service, Kagoshima (JP)

( * ) Notice: Subject to any disclaimer, the term of this patent is extended or adjusted under 35 U.S.C. 154(b) by 19 days.

(21) Appl. No.: 13/808,160

(22) PCT Filed: Jul. 7, 2011

(86) PCT No.: PCT/JP2011/003889

§ 371 (c)(1),
(2), (4) Date: Mar. 14, 2013

(87) PCT Pub. No.: WO2012/004999

PCT Pub. Date: Jan. 12, 2012

(65) Prior Publication Data

US 2013/0205969 A1 Aug. 15, 2013

(30) Foreign Application Priority Data

Jul. 8, 2010 (JP) ..... 2010-155776

(51) Int. Cl.
*G10C 3/18* (2006.01)
*G10C 3/16* (2006.01)

(52) U.S. Cl.
CPC ..... *G10C 3/161* (2013.01)
USPC ..... 84/242

(58) Field of Classification Search
USPC ..... 84/173, 174, 236–243
See application file for complete search history.

(56) References Cited

U.S. PATENT DOCUMENTS

| | | | | |
|---|---|---|---|---|
| 608,177 | A | 8/1898 | Cobb | |
| 4,879,939 | A | 11/1989 | Wall | |
| 8,541,673 | B2 * | 9/2013 | Jones et al. | 84/243 |
| 2012/0240743 | A1 * | 9/2012 | Jones et al. | 84/243 |

FOREIGN PATENT DOCUMENTS

| | | | |
|---|---|---|---|
| GB | 1099280 | | 1/1968 |
| JP | 48007809 | B1 | 3/1973 |
| JP | 53070810 | A | 6/1978 |
| JP | S58-128491 | | 8/1983 |
| JP | 63088599 | A | 4/1988 |
| JP | 63098698 | A | 4/1988 |

(Continued)

OTHER PUBLICATIONS

Extended European Search Report dated Mar. 31, 2014 in European Patent Application No. 11803336.4.

(Continued)

*Primary Examiner* — Kimberly Lockett
(74) *Attorney, Agent, or Firm* — Plumsea Law Group, LLC

(57) ABSTRACT

Disclosed is an action for an upright piano capable of expressing rich tone variation and improving the continuous press performance of the same key. In the action (1) for an upright piano, there are formed a guide member (67) fixed to a center rail (14) and continuing in the horizontal direction; and a member to be guided (73) sliding along the guide member (67). A hammer under rail (19) on which a hammer shank (45) abuts is affixed to a hammer rail (18), and butt flanges (41) are affixed to the member to be guided (73). The member to be guided (73) is connected to a pedal (77) via an upthrust bar (81) and a balance (79) such that the member to be guided (73) is slid to the right or left with the force of working the pedal (77) by the player.

8 Claims, 8 Drawing Sheets

(56) References Cited

FOREIGN PATENT DOCUMENTS

| | | | |
|---|---|---|---|
| JP | 05038400 | Y2 | 9/1993 |
| JP | 2007093655 | A | 4/2007 |
| JP | 2007293098 | A | 11/2007 |
| JP | 2008256787 | A | 10/2008 |
| WO | 2007/037063 | | 4/2007 |

OTHER PUBLICATIONS

International Search Report dated Aug. 2, 2011.

* cited by examiner

ACTION FOR UPRIGHT PIANO

This application is a national stage application of International Patent Application No. PCT/JP2011/003889, filed Jul. 7, 2011 (WO 2012/004999, published Jan. 12, 2012), which is herein incorporated by reference in its entirety.

TECHNICAL FIELD

The present invention relates to actions of an upright piano.

BACKGROUND ART

First, the terms used in the following description are defined. Unless otherwise notified, the directions of an upright piano are those seen from the piano player's side; that is, "front", "back", "left", and "right" are the front, back, left and right, respectively of the upright piano, from the perspective of the piano player. "Clockwise" and "counter-clockwise" are the clockwise and counter-clockwise, respectively, from the perspective of the piano player. The term a "rest state" means a "state where no force is applied by a piano player to a key". It also means that "the front of a key closest to a piano player is located at the highest point of its travel" The term a "ready state" means a "state of an action during the time when the key is in the rest state". The expression that a "pedal is in the activated state" means that "a piano player is pressing a pedal" The expression that a "pedal is in the released state" means "no force is applied to a pedal by a piano player"

A typical upright piano has 88 actions. Each action comprises a key, a whippen, a jack, a hammer butt, a hammer and a strong. The typical upright piano also has a shift pedal (see, Patent Document 1). The shift pedal is connected to a half-blow rail through a trap lever and a pedal rod. The half-blow rail is rotatablyrotatably supported by a hammer-rest rail. When the action is in the ready state, the hammer is abutted to the half-blow rail.

A hammer-butt flange is secured to an action rail. The hammer butt is pivotall rotatably y supported by the hammer-butt flange. The hammer butt supports the hammer. The hammer butt also supports a back stop through a back stop shank. The whippen is rotatably supported by the action rail. The jack is rotatably supported by the whippen. A protruding end of the jack is configured in such a manner that it can pushes upward a pushed-up portion of the hammer butt. A bridle wire and a back-check wire are projected from the whippen. A back check is secured to one end of the hack-check wire.

Each string is composed of one to three piano wires. An action of an upright piano has a bridle strap (see, Patent Document 2). The bridle strap is a unique part of upright pianos. Grand pianos have no bridle strap. The bridle strap connects the back stop and the bridle wire. More specifically, the rear end of the bridle strap is connected to the junction between the back stop and the back stop shank. The front end of the bridle strap is connected to the end of the bridle wire.

Unless otherwise specified, a "length of the bridle strap" or an "expansion of the bridle strap" refers to a "length of a segment of the bridle strap extending between a point where the bridle strap is connected to the back stop and a point where the bridle strap is connected to the bridle wire". Unless otherwise specified, a "minimum length of the bridle strap" has a similar meaning.

When the action is in the ready state, a piano player applies a force to a key to depress the key. The whippen rotates upward, the jack pushes up the hammer butt, and the hammer rotates backward. Then, the jack escapes from under the hammer butt and the hammer is disconnected from the motion of the key. The hammer returns back due to the moment of inertia to hit the string. After hitting the string, the hammer rotates forward. The back check then captures the back stop and the hammer is stopped.

Next, the piano player releases the key. The whippen rotates downward, and the back check releases the back stop. The whippen further rotates downward, and the bridle wire rotates downward along with the whippen. The distance between the back stop and the bridle wire is increased, and the bridle strap pulls the hammer butt forward. The hammer butt rotates forward along with the hammer. The rotated hammer is abutted against the half-blow rail. The time interval from the point when the back check releases the back stop to the point when the hammer is abutted against the half-blow rail is denoted by $T_1$. In addition, when the whippen falls, the jack slips under the hammer butt. The action is returned to its ready state.

When the piano player depresses the key, the protruding end of the pushing-up portion of the jack pushes up the pushed-up portion of the hammer butt. The protruding end of the pushing-up portion of the jack is made of wood or plastic. Thus, the protruding end of the pushing-up portion is hard. The pushed-up portion of the hammer butt is covered with a piece of non-woven fabric or leather. Thus, the pushed-up portion is soft. Such a portion of the pushed-up portion that is hit by the protruding end of the pushing-up portion is pressed and become thin with time. As a result, the pushed-up portion has an uneven surface or difference in level at a boundary between a portion hit by the protruding end of the pushing-up portion and a portion that is not affected by the protruding end of the pushing-up portion.

When the piano player presses a shift pedal, the shift pedal is shifted from the released state to the activate state. The shift pedal pushes up the pedal rod through the trap lever, and the pedal rod in turn pushes up the half-blow rail. The half-blow rail rotates backward. The hammer is pushed up by the half-blow rail and rotates backward to a closer position to the string. This means that the hammer travels a shorter distance when it rotates to hit the string while the piano player is depressing the shift pedal. With the shorter rotation distance of the hammer, a weaker sound is produced when the hammer hit the string. Thus, the piano player can change degrees of loudness or softness of a note by using the shift pedal.

In the following description, a "state a" means a "state where the action is in the ready state, and the shift pedal is in the released state." A "state b" means a "state where the action is the ready state and the shift pedal is in the activated state". In the state a, the piano player depresses the shift pedal. The hammer rotates backward along with the hammer butt, and the back stop moves away from the bridle wire. This situation corresponds to the state b. In the state b, a distance between the back stop and the bridle wire is denoted by $D_9$. The distance $D_9$ is a factor that determines the minimum length $L_{B1}$ for a conventional bridle strap.

The length $L_{B1}$ corresponds to a length with which the bridle strap has no slack in the state b. The length $L_{B1}$ also corresponds to a length with which the bridle strap does not pull the hammer butt forward in the state b. When the length of the bridle strap is less than $L_{B1}$, the following problems arise. In the state a, when the piano player depresses the shift pedal, the hammer and the hammer butt rotate backward. During this, the hammer butt pulls the bridle strap backward. The bridle strap pulls the whippen upward, and the whippen rotates upward. As a result, the tail of the key is lifted and the front of the key falls, both without the piano player's intent. In order to avoid this, the bridle strap has a length of at least $L_{B1}$.

CITED TECHNICAL DOCUMENTS

Patent Documents

Patent Document 1: Japanese patent laid-open No. 2007-293098

Patent Document 2: Japanese patent laid-open No. 2008-256787

SUMMARY OF THE INVENTION

Problems to be Solved by the Invention

The aforementioned upright piano has following problems. Whether the piano player uses the shift pedal is independent of the number of piano wires hit by the hammer. The hammer hits the same number of piano wires at all times. The only advantage of using the shift pedal lies in that the piano player can change the degrees of loudness or softness of a note. This does not change the sound itself, only producing a monotonic sound. On the contrary, when the piano player depresses a shift pedal in a grand piano, different sounds are produced. Upright pianos are inferior to grand pianos in terms of the capacity of producing expressive sounds.

The hammer is made up of a hammer head and a hammer shank. The hammer head hits the string. In upright pianos, a certain predetermined portion of the hammer head is always used to hit the string. This fact is another reason why the upright pianos are inferior to the grand ones in terms of the capacity of producing expressive sounds. As described above, after the hammer hits the string, the back check catches the back stop. Then, the bridle strap pulls the hammer forward to its original position.

When the back check catches the back stop, a distance between the back stop and the bridle wire is smaller than the distance $D_9$. Thus, the bridle strap has a slack. When the bridle strap pulls the hammer butt, the slack of the bridle strap affects badly. Downward rotation of the whippen increases the distance between the back stop and the bridle wire. This removes the slack of the bridle strap and the bridle strap can pull the hammer butt.

In order to remove the slack of the bridle strap, the whippen is required to rotate downward. This rotation takes a time. A time interval from the point when the back check releases the back stop and the point when the bridle strap begins to pull the hammer butt is denoted by $T_2$. The presence of the time $T_2$ results in a shorter time $T_1$. The time $T_2$ is a cause of worse playing of repeated notes on the single key in the upright piano.

According to a certain experiment that the present inventor knows, the piano player can play 7 repeated notes per second on the same key of an upright piano. On the contrary, the piano player can play 14 repeated notes per second on the same key of a grand piano. The present invention is directed to solve the aforementioned problems and an object thereof is to provide an action of an upright piano with which it is possible to provide more expressive change in different sounds and better playing of repeated notes on a single key.

Means to Solve the Problems

In order to solve the problem, the present invention has a following configuration. An action of an upright piano according to an invention of claim 1 comprises a key, an action rail extending horizontally in the right-and-left direction from the perspective of a piano player's side, a whippen rotatably supported by the action rail and located on a rear end of the key, a jack rotatably supported by the whippen, a hammer butt to be pushed up by the jack, a hammer supported by the hammer butt, and a string to be hit by the hammer, wherein a guiding member extending longitudinally along said action rail is secured to said action rail, said guiding member has a guided member that is slidable along said guiding member, said hammer butt being rotatably supported by a hammer-butt flange, the hammer-butt flange being secured to the guided member, said guided member is connected to a pedal rod via a joint member, the pedal rod being connected to a pedal, an elastic member biases said guided member in a right or left direction from the perspective of the piano player's side, and a force applied by a piano player to said pedal acts on said guided member through said pedal rod and said joint member, the force acting on said guided member having a direction that is opposite to the direction of a bias force applied by said elastic member.

When the piano player applies a force to the pedal, this force acts on the guided member through the pedal rod and the joint member. The force acting on the guided member is a force in a longitudinal direction of the guiding member and a horizontal (right to left) force. This force causes the guided member to slide along the guiding member. As in conventional upright pianos, a trap lever may be provided between the pedal and the pedal rod. The joint member connects the guided member and the pedal rod. The joint member converts a vertical force transmitted from the pedal rod into a horizontal (right-and-left) force. This horizontal force is transmitted from the joint member to the guided member.

The joint member may be, for example, a wire or a chain. The wire or the chain may be on a pulley. The joint member may be, for example, a member such as a pounder. In this case, the guided member may be rotatably connected to the member such as a pounder at any position thereon. The pedal rod is also rotatably connected the member such as a pounder at a different position thereon. The member such as a pounder may have one or more joint (s) that can be bent in the middle portion of the member.

The joint member may be, for example, a rotary member that can rotate. In this case, for example, the guided member is rotatably connected at to the rotary member a position other than the rotation center of the rotary member. The pedal rod is rotatably connected to the rotary member at a position other than the rotation center of the rotary member. The position where the guided member is connected to the rotary member is different from the position where the pedal rod is connected to the rotary member. It is preferable that a line segment connecting the rotation center of the rotary member and the joint position of the guided member is perpendicular to a line segment connecting the rotary center of the rotary member and the joint position of the pedal rod. When these two line segments cross at a right angle, the vertical force applied from the pedal rod to the rotary member is effectively converted into a horizontal (right-and-left) force. This horizontal force is applied from the rotary member to the guided member. In addition, it is preferable that the rotation center of the rotary member, the joint position of the guided member, and the joint position of the pedal rod are not on the same straight line.

The joint member may be, for example, a rack and a pinion. In this case, for example, a rack that extends horizontally in the right-and-left direction is formed on the guided member. The pinion that engages with the rack is rotatably mounted to a static member such as the action rail. In addition, an arm is provided on the pinion that is integrally operated with the pinion. One end of this arm is rotatably connected to one end of the pedal rod. When the pedal rod moves up and down, the arm of the pinion rotates, and thus the pinion rotates. The pinion is only rotated and the rotation center of the pinion is not displaced. When the pinion rotates, the rack moves from right to left or vise versa in response to a force applied by the pinion. Then, the guided member moves from right to left or vise versa along with the rack.

The elastic member biases the guided member in the right or left direction. The force applied by the elastic member may act on the guided member directly or indirectly through another member. When the piano player applies no force to the pedal, the elastic member pulls the guided member towards one end of the guiding member. When the piano player applies a three to the pedal, the guided member receives, from the joint member, a force in the direction opposite to the bias force applied by the elastic member. The guided member slides along the guiding member against the bias force applied by the elastic member. When the piano player releases the pedal and no force is applied thereto, the bias force applied by the elastic member returns the guided member to its original position before it slides.

The hammer-butt flange is secured to the guided member. Accordingly, the hammer-butt flange, the hammer butt, and the hammer slide along with the guided member. The distance along which the guided member slides is equal to the distance along which the hammer-butt flange, the hammer butt, and the hammer slide. The distance along which the guided member slides varies depending on the depth that the piano player presses the pedal. When the piano player presses the pedal to the lowest point of its travel, the distance along which the guided member slides becomes the maximum. The depth that the piano player presses the pedal depends on the magnitude of the force that the piano player applies to the pedal. When the depth that the piano player presses the pedal is equal to zero, no force is applied by the piano player to the pedal. When the piano player presses the pedal to the lowest point of its travel, the force applied by the piano player to the pedal is the maximum.

When the piano player applies a force to the pedal, the hammer slides horizontally in the right-and-left direction. This alters the position of the hammer head relative to the string. Depending on the distance along which the hammer slides, the number of piano wires hit by the hammer varies. In addition, the area on the hammer head that hits the piano wire also varies. The area on the hammer head that hits the piano wire is an area on the hammer felt that is a part of the hammer head.

Changing the number of the piano wires hit by the hammer produces different sounds when the hammer hits the string. In addition, changing the area on the hammer head that hits the piano wire produces different sounds when the hammer hits the string. When a certain portion of the hammer head often hits the piano wire, this portion is hardened. The remaining portion of the hammer head is still soft. When the hammer slides, the hardness of the area on the hammer head that hits the piano wire is changed.

The piano player can change degrees of loudness or softness of a note by means of changing the magnitude of the force to depress the key. This can eliminate a shift pedal provided in a conventional upright piano. In addition, the half-blow rail is not required to rotate backward. Accordingly, for example, the half-blow rail may be secured to the hammer-rest rail. The half-blow rail and the hammer-rest rail may be integrally formed as a single member.

Since the half-blow rail is not required to rotate backward, the back stop does not rotate backward in the action in the rest state. Thus, the minimum length $L_{B2}$ of the bridle strap is shorter than the aforementioned length L. This reduces the amount of the slack to be removed from the bridle strap when the bridle strap pulls forward the hammer after it hits the string. The time $T_2$ is reduced and the time $T_1$ is also reduced. Accordingly, the upright piano permits better playing of repeated notes on the single key.

The distance along which the guided member slides has an upper limit. This is because the hammer felt should hit its associated piano wire(s). If the guided member slides horizontally to the left when the piano player presses the pedal, the upper limit of the distance along which the guided member slides is a "horizontal distance in the right-and-left direction between the right edge of the hammer felt when the pedal is in the released state and the leftmost piano wire associated with the hammer felt in question". In addition, if the guided member slides horizontally to the right when the piano player depresses the pedal, the upper limit of the distance along which the guided member slides is a horizontal distance in the right-and-left direction between the left edge of the hammer head when the pedal is in the release state and the rightmost piano wire associated with the hammer felt in question".

In addition, the distance along which the guided member slides may affect the length $L_{B2}$. Because of this, the length $L_{B2}$ may be increased. However, the increased amount of the length $L_{B2}$ is significantly smaller than the difference between the length $L_{B2}$ and the length $L_{B1}$. Accordingly, even in such a case, the time $T_2$ is reduced and the upright piano permits better playing of repeated notes on the single key.

The action of the upright piano according to an invention of Claim 2 is the action of the upright piano of Claim 1, wherein said jack has a pushing-up portion that pushes up said hammer butt, said hammer butt has a pushed-up portion to be pushed up by said pushing-up portion, a right edge of a protruding end of said pushing-up portion is located immediately beneath a right edge of said pushed-up portion or is away to the right from the right edge of said pushed-up portion from the perspective of the piano player's side, when the piano player applies no force to said key and said pedal, and a left edge of the protruding end of said pushing-up portion is located immediately beneath a left edge of said pushed-up portion or is away to the left from the left edge of said pushed-up portion from the perspective of the piano player's side, when the piano player applies no force to said key and said pedal.

The action having such a structure is preferable for the upright piano in which pedal is not used so frequently. The jack is rotatably supported by the whippen. The whippen is rotatably supported by the action rail. When the guided member slides, the jack does not slide. When the action is in the ready state, the pushed-up portion of the hammer butt is rest on the protruding end of the pushing-up portion of the jack. When the guided member slides in the right-and-left direction, the pushed-up portion of the hammer butt slides on the protruding end of the pushing-up portion of the jack.

If the area on the pushed-up portion of the hammer butt that contacts with the protruding end of the pushing-up portion of the jack has an uneven portion, the following problem will arise. When the protruding end of the pushing-up portion of the jack slips under the uneven portion or slips out of the uneven portion, an upward force is applied from the jack to the hammer butt. This force causes the hammer butt to bounce upward, and the hammer thus rotates backward. A larger uneven portion may result in an unexpected hit of the hammer to the string without the piano player's intent.

The following description is for the case where the pedal is in the released state and the key is in the rest state. In this case, when seen from the perspective of the piano player's side, the entire length of the pushed-up portion of the hammer butt from the right edge to the left edge is in contact with the protruding end of the pushing-up portion of the jack from above. Accordingly, when seen from the perspective of the piano player's side, the entire length of the pushed-up portion of the hammer butt from the right edge to the left edge is abutted against the pushing-up portion of the jack, and equally compressed to be thinner. Thus, when seen from the piano player's side, the pushed-up portion of the hammer butt has no level difference or uneven portion(s) between the right edge and the left edge of it.

Accordingly, when the guided member slides in the right-and-left direction, the pushed-up portion of the hammer butt smoothly slides on the protruding end of the pushing-up portion of the jack. The protruding end of the pushing-up portion of the jack never slips under any uneven portion. The protruding end of the pushing-up portion of the jack never slips out of any uneven portion. The hammer butt never bounds upward without the piano player's intent when the guided member slides. In addition, the hammer never rotates backward without the piano player's intent.

The action of the upright piano according to an invention of Claim 3 is the action of the upright piano of Claim 1, wherein said jack has a pushing-up portion that pushes up said hammer butt, said hammer butt has a pushed-up portion to be pushed up by said pushing-up portion, a right edge of a protruding end of said pushing-up portion is always located immediately beneath a right edge of said pushed-up portion or is always away to the right from the right edge of said pushed-up portion from the perspective of the piano player's side, when the piano player applies no force to said key, and a left edge of the protruding end of said pushing-up portion is always located immediately beneath a left edge of said pushed-up portion or is always away to the left from the left edge of said pushed-up portion from the perspective of the piano player's side, when the piano player applies no force to said key.

The action having such a structure is preferable for the upright piano in which pedal is used so frequently. The following description is for the case where the key is in the rest state. It is not considered whether the pedal is in the released state or in the activated state. In this case, when seen from the perspective of the piano player's side, the entire length of the pushed-up portion of the hammer butt from the right edge to the left edge is in contact with the protruding end of the pushing-up portion of the jack from above. When seen from the perspective of the piano player's side, the entire length of the pushed-up portion of the hammer butt from the right edge to the left edge is abutted against the pushing-up portion of the jack, and equally compressed to be thinner. Thus, when seen from the piano player's side, the pushed-up portion of the hammer butt has no level difference or uneven portion (s) between the right edge and the left edge of it.

Accordingly, when the guided member slides in the right-and-left direction, the pushed-up portion of the hammer butt smoothly slides on the protruding end of the pushing-up portion of the jack. The protruding end of the pushing-up portion of the jack never slips under any uneven portion. The protruding end of the pushing-up portion of the jack never slips out of any uneven portion. The hammer butt never bounds upward without the piano player's intent when the guided member slides. In addition, the hammer never rotates backward without the piano player's intent.

The action of the upright piano according to an invention of Claim 3 is the action of the upright piano of any one of Claims 1 to 3, wherein said hammer butt, a back stop shank extending from said hammer butt towards a piano player's side, and a back stop secured to an end of the back stop shank form a first assembly, a bridle wire is projected from said whippen, a bridle strap connects said first assembly and said bridle wire, a position on said bridle wire at which said bridle strap is connected thereto is defined as a first joint position, a position, on a length of said bridle strap contacting with said first assembly, that is closest to said first, joint position when said bridle strap has no slack between said first assembly and said bridle wire is defined as a first contact position, and a position in said first assembly contacting the first contact position is defined as a second contact position, a length of said bridle strap between said first joint position and said first contact position is defined as a first length, a distance between said first joint position and said second contact position when no force is applied by the piano player to said key and said pedal is defined as a first distance, provided that it is assumed that said bridle strap is not present, a distance between said first joint position and said second contact position when a distance along which said guided member slides in response to the application of force by the piano player to said pedal is the maximum and no force is applied by the piano player to said key is defined as a second distance, provided that it is assumed that said bridle strap is not present, a distance between said first joint position and said second contact position at a moment when said hammer hits said string and when no force is applied by the piano player to said pedal is defined as a third distance, provided that it is assumed that said bridle strap is not present, a distance between said first joint position and said second contact position at a moment when said hammer hits said string and when a distance along which said guided member slides in response to the application of force by the piano player to said pedal is the maximum is defined as a fourth distance, provided that it is assumed that said bridle strap is not present, and said first length is a length obtained by multiplying the longest distance of said first distance, said second distance, said third distance, and said fourth distance by a value of from 1 to 1.03.

In the following description, a "state c" means a "state in which the pedal is in the released state and the action is in the ready state". A "state d" means a "state in which the pedal is in the activated state and the pedal is pressed to its lowest point of its travel as well as the action is in the ready state". A "state e" means a "moment at which the hammer hits the string and the pedal is in the released state". A "state f" means a "moment at which the hammer hits the string and the pedal is in the activated state, as well as the pedal is pressed to the lowest point of its travel".

First, in the state c, it is assumed that the bridle strap is not present. In this case, a distance between the first joint position and the second contact position corresponds to a first distance. In the state d, it is assumed that the bridle strap is not present. In this case, a distance between the first joint position and the second contact position corresponds to a second distance. In the state e, it is assumed that the bridle strap is not present. In this case, a distance between the first joint position and the second contact position corresponds to a third distance. In the state f, it is assumed that the bridle strap is, not present. In this case, a distance between the first joint position and the second contact position corresponds to a fourth distance.

When it is assumed that the bridle strap is not present, the first joint position means the "first joint position when the bridle strap is present" while the second contact position means the "second contact position when the bridle strap is present". Depending on the size and shape of the parts forming the action, the lengths of the first distance, the second distance, the third distance and the fourth distance also vary. The longest distance of the first through fourth distances is the minimum length for the first length.

if the first length has a length that is equal to or longer than the first distance, the front of the key does not fall without the piano player's intent in the state c. If the first length has a length that is equal to or longer than the second distance, the front of the key does not fall without the piano player's intent in the state d. If the first length has a length that is equal to or longer than the third distance, the bridle strap does not pull the hammer butt forward in the state e. In addition, the rotation speed of the hammer when it hits the string is not decreased.

If first length has a length equal to or longer than the fourth distance, the bridle strap does not pull the hammer butt forward in the state f. In addition, the rotation speed of the hammer when it hits the string is not decreased. Accordingly, when the first length is equal to or longer than the longest distance of the first through fourth distances, the front of the key does not fall without the piano player's intent. In addition, the rotation speed of the hammer when it hits the string is not decreased. The minimum length for the first length is the longest distance of the first through fourth distances.

The minimum length $L_{B2}$ of the bridle strap is a length as follows. First, the "position where the first assembly is connected to the bridle strap" is the "second joint position". The "length of the bridle strap between the second joint position and the first contact position" is the "second length". The length $L_{B2}$ is a total of the minimum length for the first length and the second length.

The following description is for the case where the length of the bridle strap is a "total of the length obtained by multiplying the minimum length for the first length by a value of 1 to 1.03 and the second length". In this case, in the state e f, a slack of the bridle strap is denoted by $S_1$. A slack $S_2$ represents a "slack of a bridle strap at the moment when a hammer hits a string in a conventional action in which a half-blow rail rotates". The slack $S_1$ is smaller than the slack $S_2$. Thus, the time $T_2$ is shorter than in the case of conventional actions. As a result, the upright piano permits better playing of repeated notes on the single key.

In addition, the present inventor examined how the bridle straps of different lengths affect the feeling of the piano player from the viewpoint of playing repeated notes on the single key. A "first case" means "the case where the first length is equal to the longest distance of the first through fourth distances". A "second case" means "the case where the first length is a length obtained by multiplying the longest distance of the first through fourth distances by a value of 1.03". A "third case" means the case where the first length is a length obtained by multiplying the longest distance of the first through fourth distances by a value larger than 1.03". When comparing the first case and the second case, the piano player felt no difference in terms of the playing of repeated notes on the single key. However, when comparing the first case and the third case, the piano player felt that the third case is inferior to the first case in terms of the playing of repeated notes on the single key.

Accordingly, it is preferable that the first length is a "length obtained by multiplying the longest distance of the first through fourth distances by a value ranging from 1 to 1.03" from the viewpoint of the feeling that the piano player has when he or she plays repeated notes on the single key. With the first length having such a range of lengths, the action can be adjusted more easily. In addition, with the first length having such a range of lengths, it becomes easier to address the expansion and compression of the bridle strap due to temperature or humidity. It should be noted that the first contact position may vary depending on the shape end the size of the first assembly and that the second joint position also may vary. It is needless to say that the second joint position may be completely overlapped with the first contact position.

Effect of the Invention

The action of the upright piano as described above can help the piano player to play notes more expressively and can provide better playing of repeated notes on a single key.

MODES FOR CARRYING OUT THE INVENTION

Figure 1:
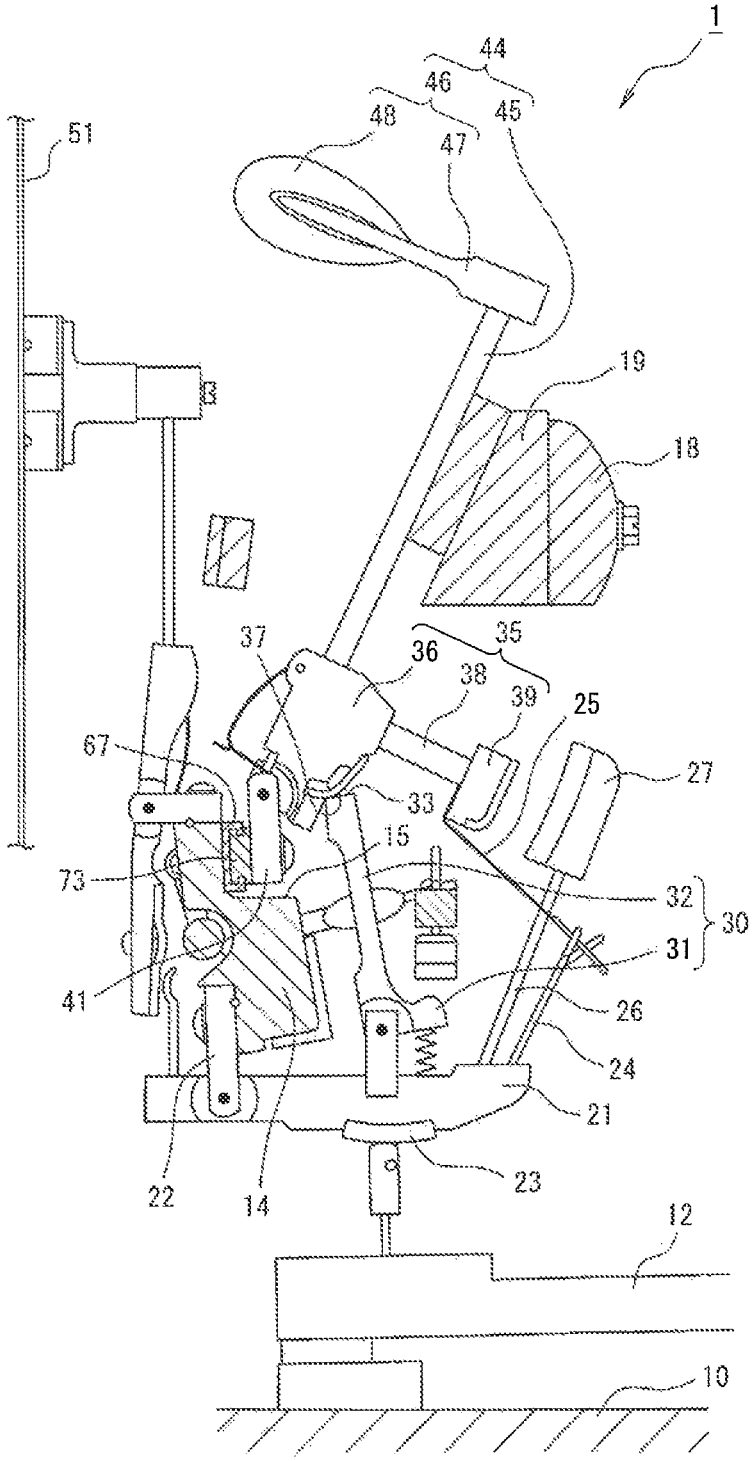
[FIG. 1] A view showing a configuration of an action of an upright piano.

Modes for carrying out the present invention are described with reference to FIGS. 1 to 8. The right side of FIG. 1 corresponds to the side where a piano player sits. The lower right of FIG. 2 corresponds to the side where a piano player sits. The bottom of FIG. 5 corresponds to the side where a piano player sits. As shown in FIG. 1, an upright piano comprises a number of actions 1 (only one of which is illustrated). The action 1 has a key 12, an action rail 14, a hammer-rest rail 18, a whippen 21, a jack 30, a hammer butt 36, a hammer 44, and a string 51.

Balance rail pins (not shown) are provided on a key frame 10. The key 12 is supported rotatably on a balance rail pin at the center of the key 12. Action brackets (not shown) are provided on each end of the key frame 10. The action brackets hold the main action rail 14 and the hammer-rest rail 18 between them. A half-blow rail 19 is secured to the back surface of the hammer-rest rail 18, and the half-blow rail 19 is thus static. Each of the action rail 14, the hammer-rest rail 18, and the half-blow rail 19 extends horizontally in the right-and-left direction.

The wippen 21 extends back and upward from the key 12. The rear end of the whippen 21 is hinged with a whippen flange 22 that is connected to the lower end of the action rail 14. The whippen 21 is rest on the tail of the key 12 through a heel 23. The jack 30 is provided above the whippen 21 in such a manner that the jack 30 can pivot on a fulcrum. A back-check wire 26 and a bridle wire 24 extend upward from the front end of the wippen 21. The jack 30, the back-check wire 26 and the bridle wire 24 are aligned in this order from back to front.

Figure 7:
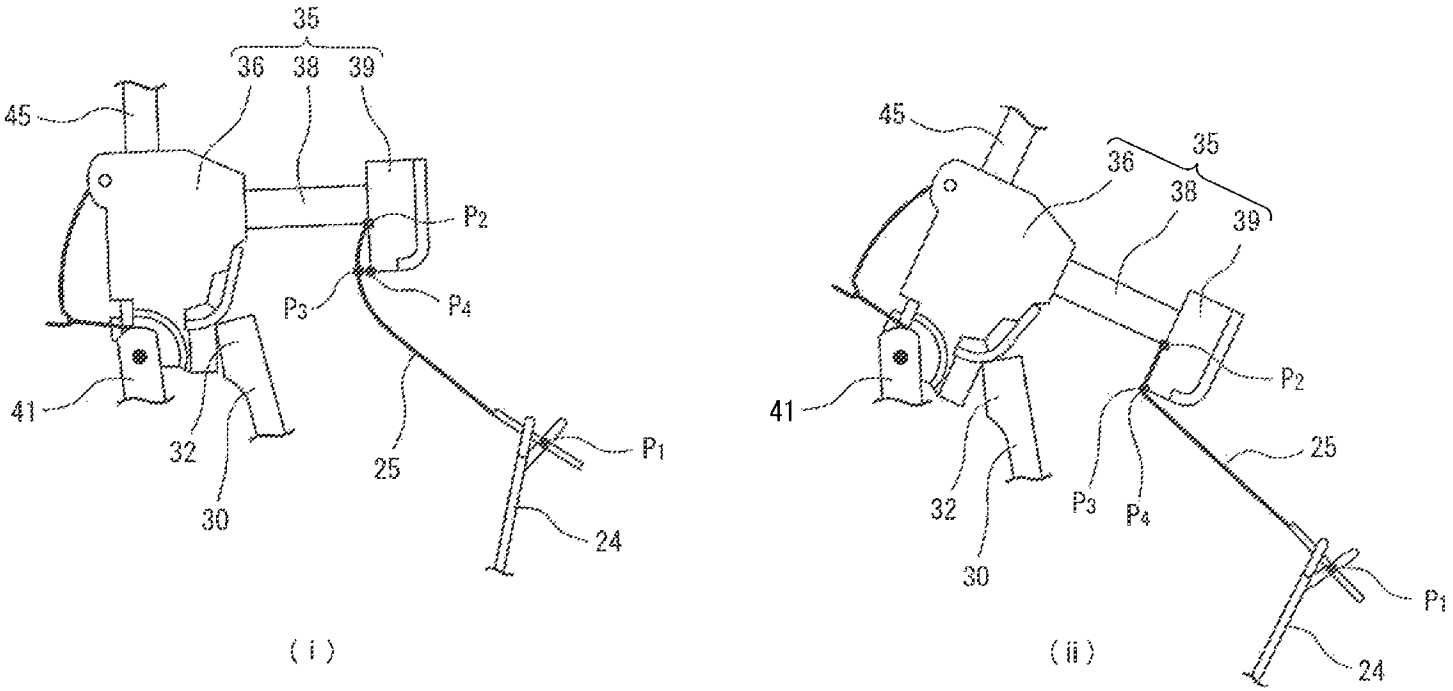
[FIG. 7] A view illustrating a positional relation between a bridle strap and a first assembly in which (i) shows a case where the bridle strap has a slack, and (ii) shows a case where the bridle strap has no slack.
Figure 8:
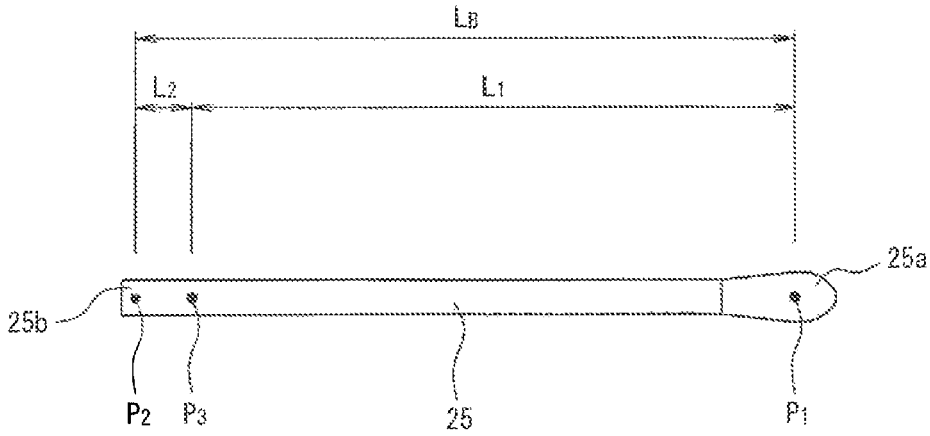
[FIG. 8] A top view of the bridle strap.

As shown in FIGS. 1, 7, and 8, the front end of a bridle strap 25 is connected to the free end of the bridle wire 24. The bridle strap 25 is a cloth strap. A point on the bridle strap 25 where it is connected with the free end of the bridle wire 24 is denoted as a first joint position $P_1$. A back check 27 is connected to the free end of the back-check wire 26.

The jack 30 has a jack tail 31 and a pushing-up portion 32. The jack tail 31 projects upward and the pushing-up portion 32 extends vertically. The rear end of the jack tail 31 is connected to the lower end of the pushing-up portion 32. The jack 30 has an "L" shape. At the corner of the "L" shape, the jack 30 is hinged with the whippen 21. A protruding end of the pushing-up portion 32 has a horizontal (right-and-left) width of $W_J$ (see FIG. 6). The action rail 14 has a stepped portion 15 in the upper surface at the front end of it. The stepped portion 15 extends horizontally in the right-and-left direction along the longitudinal direction of the action rail 14.

Figure 2:
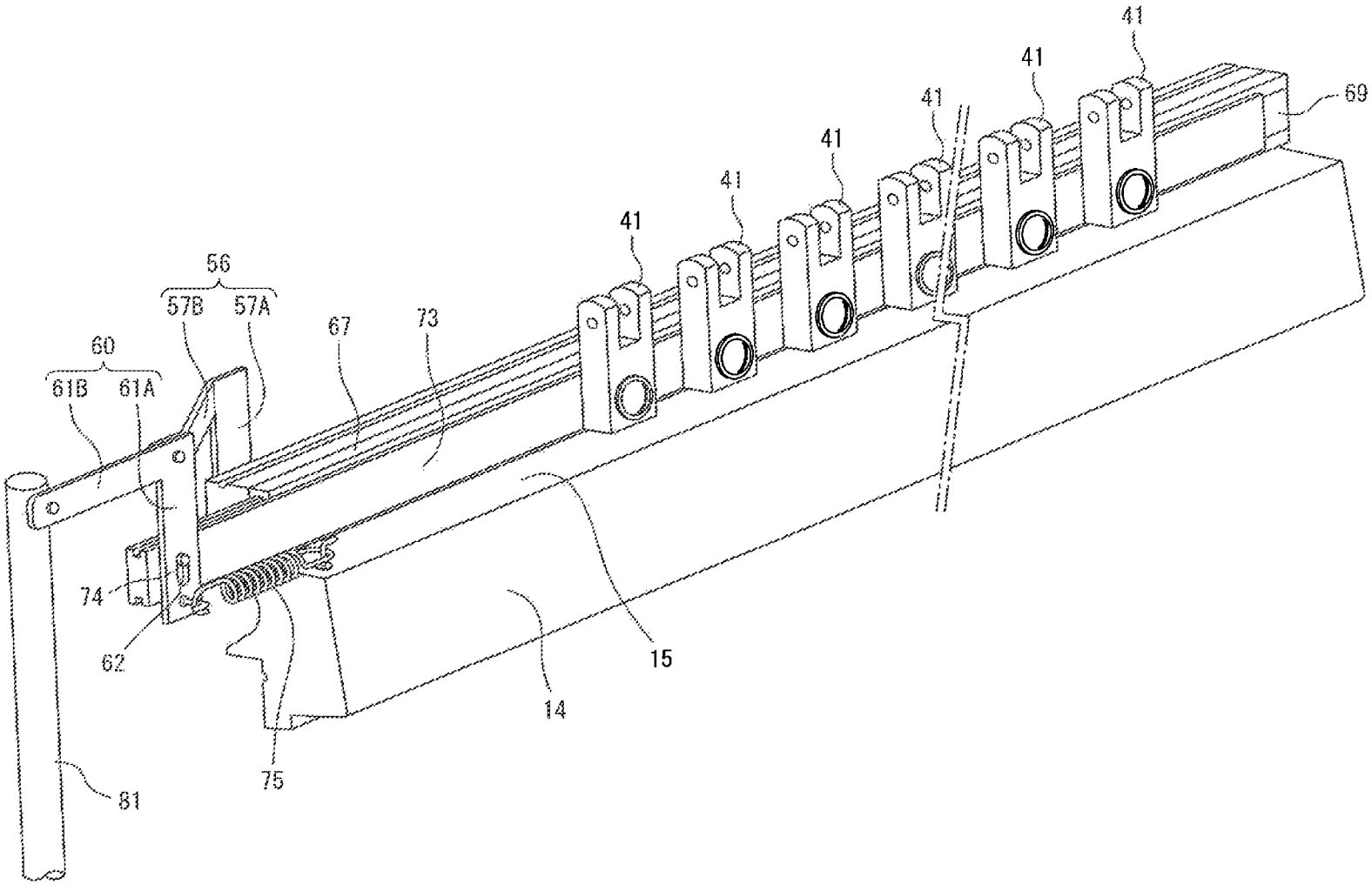
[FIG. 2] A perspective view of an action rail, a guiding member, and a guided member, seen from diagonally forward left.
Figure 3:
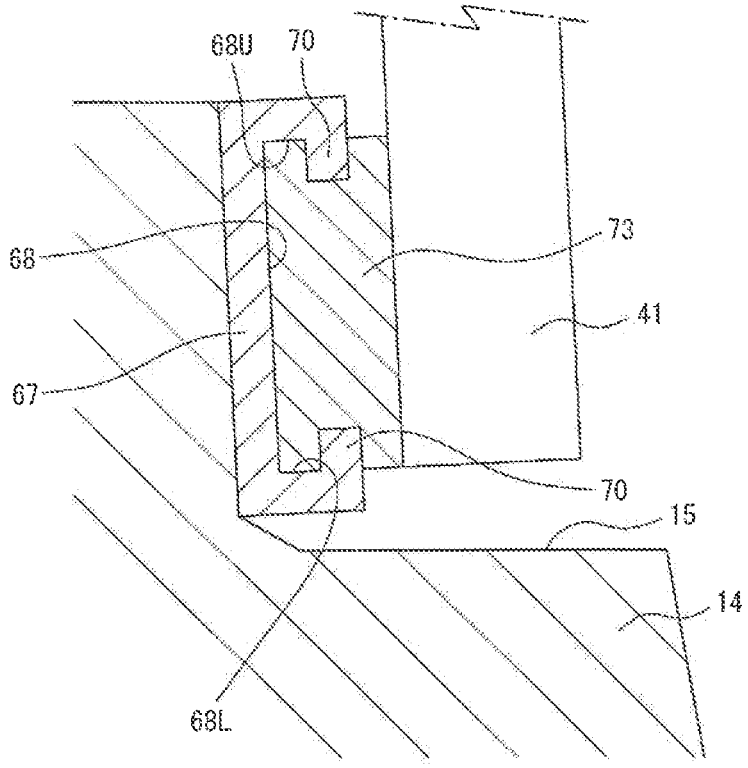
[FIG. 3] A cross-sectional view of the guiding member and the guided member.

As shown in FIG. 2, a support member 56 is attached to the back of the action rail 14 at the left end of it. The support member 56 has an arm 57A and an arm 57B. One end of the arm 57A is connected to one end of the arm 57B. Thus, the support member 56 has an "L" shape. The lower end of the arm 57A is secured to the back of the action rail 14 at the left end of it. The arm 57A extends upward from the action rail 14. The arm 57B extends diagonally forward left from the upper end of the arm 57A.

A joint member 60 is attached to the end of the arm 57B. The joint member 60 has an arm 61A and an arm 61B. One end of the arm 61A is connected to one end of the arm 61B. The arm 61A forms a right angle with the arm 61B. Thus, the joint member 60 has an "L" shape. At the corner of the "L" shape, the joint member 60 is supported rotatably on the end of the arm 57B so that it can pivot in a hypothetica surface. This hypothetica surface is in parallel to the action rail 14 and spans in a vertical direction. The joint member 60 serves as a rotary member. An oblong hole 62 is formed in the arm 61A at the end of it along the longitudinal direction of the arm 61A.

As shown in FIGS. 1 and 2, a guiding member 67 is fixed to the front surface of the stepped portion 15. The guiding member 67 extends horizontally in the right-and-left direction along the action rail 14. A groove 68 is formed in the front surface of the guiding member 67 (see FIG. 3). The groove 68 extends horizontally in the right-and-left direction along the guiding member 67. A closure portion 69 is provided at the right end of the groove 68. The closure portion 69 closes or blocks the right end of the groove 68. Upper and lower inner walls 68U and 68L, which are opposed to each other, are provided in the groove 68. The front edges of the inner walls 68U and 68L form edge portions 70, respectively (see, FIG. 3). Each edge portion 70 extends horizontally in the right-and-left direction along the guiding member 67. The edge portions 70 project inward in the groove 68. The guiding member 67 extends horizontally in the right-and-left direction and has a generally "C" shape in cross section (see, FIG. 3).

The groove 68 is covered with a guided member 73. The guided member 73 extends horizontally in the right-and-left direction and has an "H" shape in cross section. The recess of the "H" shape engages with the edge portions 70 of the groove 68. The guided member 73 is slidable in the right-and-left direction along the guiding member 67. One end of a tension spring 75 is connected to the left end of the action rail 14. The other end of the tension spring 75 is connected to the end of the arm 61A. The tension spring 75 serves as an elastic member.

The guided member 73 has a protrusion 74 at its left end on the front surface. The protrusion 74 covers a hole 62 in the arm 61A from the backside. The protrusion 74 is movable in the hole 62 along the longitudinal direction of the arm 61A. The arm 61A stands almost vertical when the right end of the guided member 73 is in contact with the closure portion 69. In this state, the protrusion 74 in the hole 62 is closest to the rotation center of the joint member 60. In addition, in this state, the arm 61B extends leftward almost horizontally.

The tension spring 75 continuously pulls the end of the arm 61A in the rightward direction. The traction force of the tension spring 75 is transmitted through the hole 62 to the protrusion 74. In other words, the tension spring 75 continuously biases the guided member 73 rightward. A number of hammer-butt flanges 41 are secured on the front surface of the guided member 73. A single hammer-butt flange 41 is associated with one key 12, one hammer butt 36 and one hammer 44. As shown in FIG. 1, the lower end of the hammer butt 36 is supported rotatably at the upper end of the hammer-butt flange 41.

A pushed-up portion 37 is formed over the lower front portion to the lower portion of the front surface of the hammer butt 36. A non-woven fabric is adhered to the pushed-up portion 37. The pushed-up portion 37 has a horizontal (right-and-left) width of $W_B$ (see, FIG. 6). A back stop shank 38 is projected from an upper portion of the front surface of the hammer butt 36. The back stop shank 38 extends forward from the hammer butt 36. A back stop 39 is secured to the end of the back stop shank 38. A combination of the hammer butt 36, the back stop shank 38, and the back stop 39 serves as a first assembly 35.

As shown in FIGS. 1 and 7, a rear end of the bridle strap 25 is connected at a junction between the back stop shank 38 and the back stop 39. A point on the bridle strap 25 where it is connected to the first assembly 35 is denoted as a second joint position $P_2$ (see, FIGS. 7 and 8). The hammer butt 36 supports the hammer 44. The hammer 44 has a hammer shank 45 and a hammer head 46. The hammer shank 45 is projected from the top surface of the hammer butt 36. The hammer head 46 is fixed to the end of the hammer shank 45. The hammer head 46 has a hammer moulding 47 and a hammer felt 48. The hammer felt 48 is opposed to the string 51. The hammer felt 48 has a horizontal (right-and-left) width of $W_H$ (see, FIG. 5(*i*)).

Figure 5:
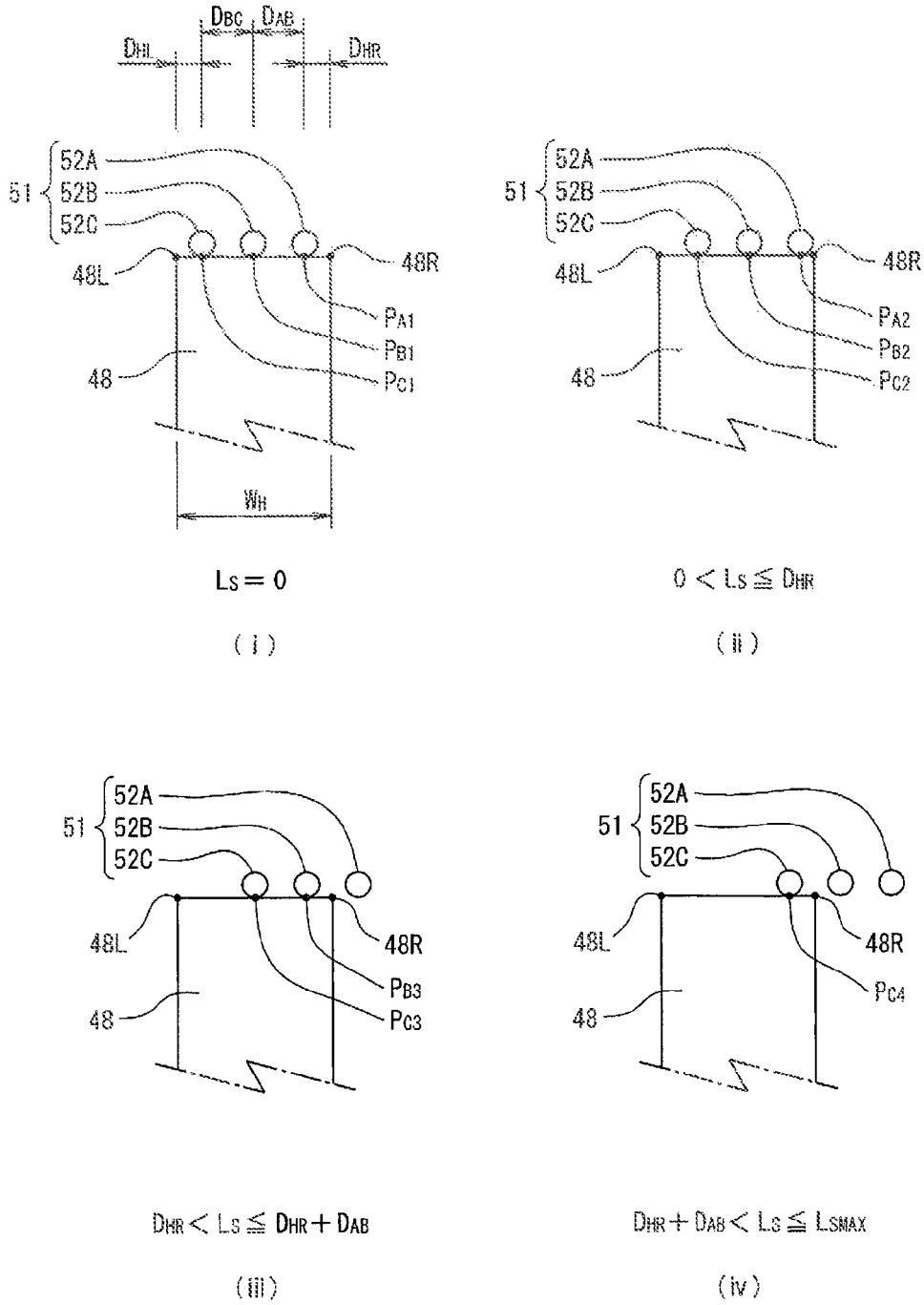
[FIG. 5] A view showing a relative position between a hammer felt and a string seen from above, at the moment when the hammer hits the string.

The half-blow rail 19 is positioned in front of the hammer shank 45. As shown in FIG. 1, the string 51 is stretched behind the hammer 44. As shown in FIG. 5, the string 51 is comprised of three piano wires 52A, 52B, and 52C. The piano wires 52A, 52B, and 520 are aligned in this order from right to left. A horizontal (right-and-left) distance between the central axis of the piano wire 52A and the central axis of the piano wire 52B is denoted as $D_{AB}$. A horizontal (right-and-left) distance between the central axis of the piano wire 52B and the central axis of the piano wire 520 is denoted as $D_{BC}$.

With the right end of the guided member 73 being in contact with the closure portion 69, a piano player depresses the key 12. As a result, the hammer felt 48 hits the piano wires 52A, 52B, and 520 at positions $P_{A1}$, $P_{B1}$ and $P_{C1}$, respectively (see, FIG. 5(*i*)).

The position $P_{A1}$ is away to the left from the right edge 48R of the hammer felt 48 by a distance $D_{HR}$. The position $P_{B1}$ is away to the left from the position $P_{A1}$ by a distance $D_{AB}$. The position $P_{C1}$ is away to the left from the position $P_{B1}$ by a distance $D_{BC}$. The left edge 48L, of the hammer felt 48 is away to the left from the position $P_{C1}$ by a distance $D_{HL}$. The horizontal (right-and-left) distance between the right edge 48R and the position $P_{C1}$ is equal to or larger than a distance $L_{SMAX}$ which will be described later. The following mathematical formulas (1) to (3) are satisfied:

$$W_H = D_{HR} + D_{AB} + D_{BC} + D_{HL} \geq L_{SMAX} + D_{HL} \quad (4)$$

$$D_{HR} \geq 0 \quad (2)$$

$$D_{HL} \geq 0 \quad (3)$$

Figure 4:
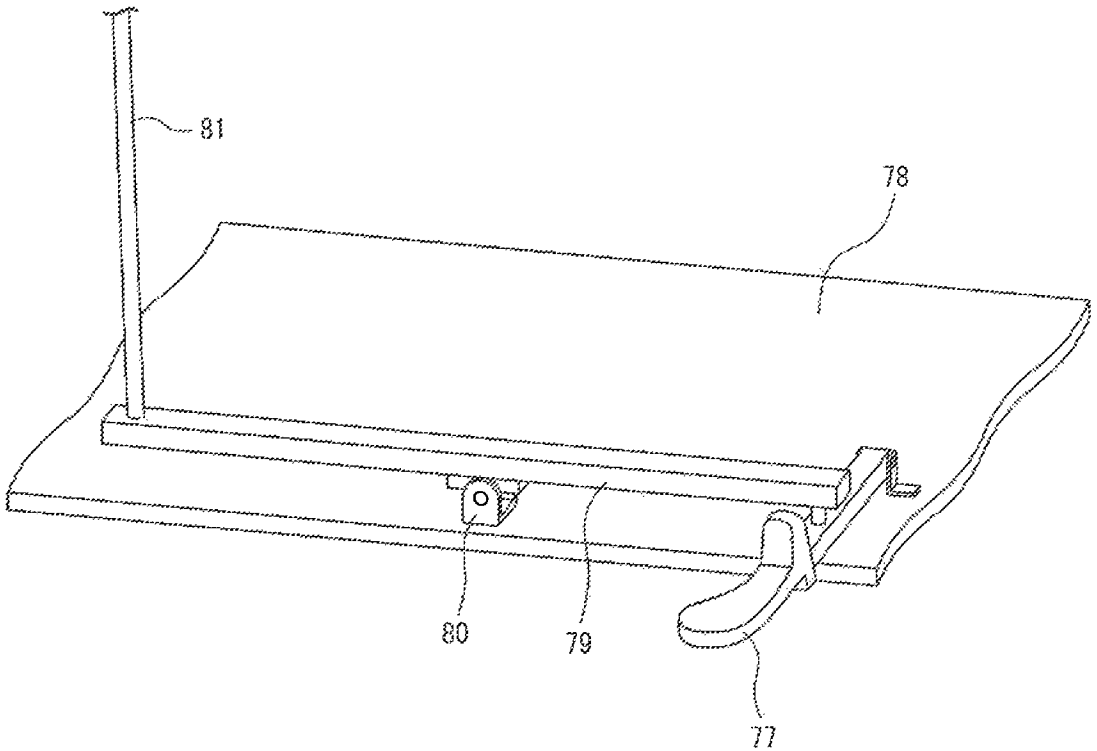
[FIG. 4] A view showing a configuration of a pedal, a trap lever, and a pedal rod.

As shown in FIG. 4, a pedal 77 is provided at a lower portion of the upright piano. The front end of the pedal 77 is projected forward from a knee panel (not shown). The rear end of the pedal 77 is supported rotatably by a base plate 78 so that it can pivot thereon. The central portion of the pedal 77 is connected to the right end of a trap lever 79 from below. The lower end of a pedal rod 81 is abutted to the left end of the trap lever 79 from above. The central portion of the trap lever 79 is supported by a fulcrum 80 in such a manner that the trap lever can swing thereon. As shown in FIG. 2, the upper end of the pedal rod 81 is connected to the end of the arm 61B of the joint member 60 so that it can pivot thereon. In other words, the guided member 73 is connected to the pedal rod 81 through the joint member 60. The pedal rod 81 is connected to the pedal 77 through the trap lever 79.

Figure 6:
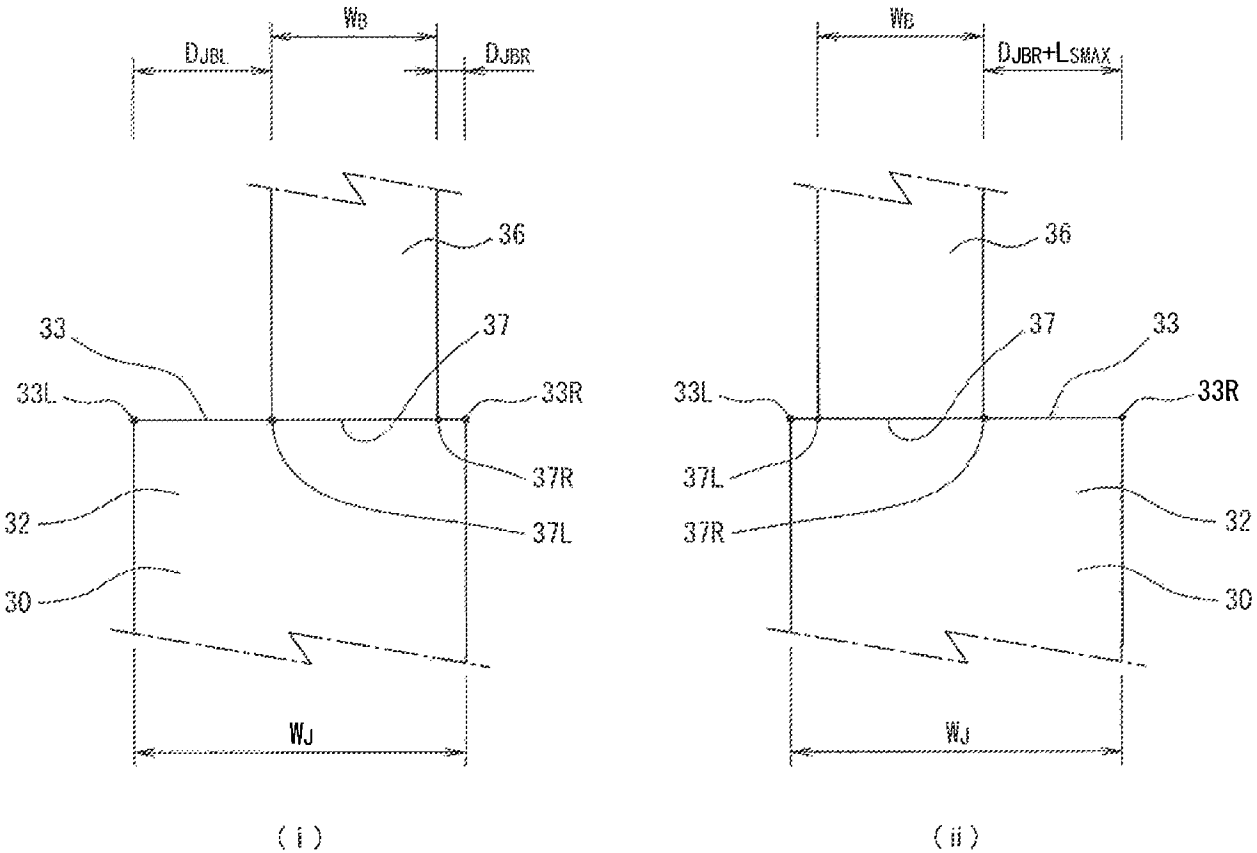
[FIG. 6] A view showing a relative position between a pushing-up portion of a hammer butt and a pushed-up portion of the jack.

When the pedal 77 is in the released state, the right end of the guided member 73 is in contact with the closure portion 69 (see, FIG. 2). The following description is for the case where the pedal 77 is in the released state and the key 12 is in the rest state. When seen from the perspective of the piano player, the hammer butt 36 is positioned relative to the jack 30 as shown in FIG. 6(*i*). The entire length from the right edge 37R to the left edge 37L of the pushed-up portion 37 is in contact with the protruding end 33 of the pushing-up portion 32 from above.

In this state, the right edge 37R of the pushed-up portion 37 is positioned to the left from the right edge 33R of the protruding end 33. A horizontal (right-and-left) distance between the right edge 37R and the right edge 33R is denoted as $D_{JBR}$. In addition, the left edge 37L of the pushed-up portion 37 is positioned to the right of the left edge 33L of the protruding end 33. A horizontal (right-and-left) distance between the left edge 37L and the left edge is denoted as $D_{JBL}$. The distance $D_{JBL}$ is equal to or longer than the distance $L_{SMAX}$ which will be described later. The following mathematical formulas (4) and (5) are satisfied:

$$W_J = D_{JBR} + W_B + D_{JBL} \geq W_B + L_{SMAX} \quad (4)$$

$$D_{JBR} \geq 0 \quad (5).$$

Next, an operation is described. The following description is for the case where the action 1 is in the ready state and the pedal 77 is in the released state. The piano player depresses the key 12 in the rest state. The whippen 21 rotates upward and the protruding end 33 of the pushing-up portion 32 of the jack 30 pushes up the pushed-up portion 37 of the hammer butt 36. As a result, the hammer 44 rotates backward. Then, the jack 30 escapes from under the hammer butt 36. The hammer 44 rotates backward due to the inertia force and hits the string 51. In this case, the positions $P_{A1}$, $P_{B1}$, and $P_{C1}$ of the hammer felt 48 hit the piano wires 52A, 52E, and 52C, respectively (see, FIG. 5(*i*)).

After hitting the string 51, the hammer 44 rotates forward. Then, the back check 27 catches the back stop 39 and the hammer 44 is stopped. Next, the piano player releases the key 12. The whippen 21 rotates downward, and the back check 27 releases the back stop 39. The whippen 21 further rotates downward, and the bridle wire 24 rotates downward along with the whippen 21. The distance between the back stop 39 and the bridle wire 24 is increased. Subsequently, the bridle strap 25 pulls the first assembly 35 forward. The first assembly 35 rotates forward along with the hammer 44. The rotated hammer 44 is abutted with the half-blow rail 19. In addition, when the whippen 21 falls, the protruding end 33 of the pushing-up portion 32 of the jack 30 slips under the pushed-up portion 37 of the hammer butt 36. The action 1 is thus returned to the ready state.

When the bridle strap 25 is pulling the first assembly 35, the bridle strap 25 has no slack. In this state, the rear end of the bridle strap 25 contacts with the back surface of the back stop 39 (see, FIG. 7(*ii*)). A point on the bridle strap 25 that is "closest to the first joint position $P_1$ on the portion contacting the back stop 39" is a first contact position $P_3$. A point on the back stop 39 that contacts with the first contact position $P_3$ is a second contact position $P_4$.

"A length of a segment of the bridle strap 25 between the first joint position $P_1$ and the first contact position $P_3$" is a first length $L_1$ (see, FIG. 8). "A length of a segment of the bridle strap 25 between the second joint position $P_2$ and the first contact position $P_3$" is a second length $L_2$. The length $L_B$ of the bridle strap 25 is a total of the first length $L_1$ and the second length $L_2$. The bridle strap 25 has an extra 25*a* ahead of the first joint position $P_1$, and an extra 25*b* behind the second joint position $P_2$. The extras 25*a* and 25*b* are necessary to connect the ends of the bridle strap 25 to the first assembly 35 and the bridle wire 24, respectively. The extras 25*a* and 25*b* are not included in the length $L_B$ of the bridle strap 25.

The following description is for the case where the pedal 77 is in the released state. The piano player presses the pedal 77 to apply a force to the pedal 77. The pedal 77 is activated. The front end of the pedal 77 falls, and the middle portion of the pedal 77 pulls the right end of the trap lever 79 downward. Then, the left end of the trap lever 79 rises, and the pedal rod 81 also rises. When the pedal rod 81 rises, the arm 61B of the joint member 60 is pushed upward, and the joint member 60 rotates clockwise. The arm 61A of the joint member 60 also rotates clockwise, which moves the end of the arm 61A to the left. The guided member 73 can move only from right to left or vise versa. Thus, the protrusion 74 of the guided member 73 moves within the hole 62 in the arm 61A toward the end of the arm 61A. In other words, the protrusion 74 moves to the left along with the rotation of the arm 61A. The arm 61A pulls the guided member 73 to the left via the protrusion 74. This means that the joint member 60 converts a vertical force applied to the arm 61B by the pedal rod 81 into a horizontal force applied to the guided member 73.

The guided member 73 pulled by the arm 61A slides to the left along the guiding member 67 against the bias force by the tension spring 75. When the guided member 73 slides, the first assembly 35 and the hammer 44 slide along with the guided member 73. A distance that the first assembly 35, the hammer 44, and the guided member 73 slide is denoted by $L_S$. The piano player releases the pedal 77. No force is applied by the piano player to the pedal 77. The pedal 77 returns to its released state. In this state, no force is transmitted from the pedal 77 to the guided member 73. The guided member 73 slides to the right because of the bias force applied by the tension spring 75 and the right end of the guided member 73 hits the closure portion 69.

When the guided member 73 slides to the right, the protrusion 74 of the guided member 73 moves within the hole 62 in the arm 61A of the joint member 60 towards the rotation center of the joint member 60. As a result of the movement of the protrusion 74, a force in the right direction is applied from the protrusion 74 to the arm 61A. Thus, the joint member 60 rotates counter-clockwise. The arm 61A returns to its generally vertical posture while the arm 61B returns to its generally horizontal posture. The protrusion 74 returns to the position closest to the rotation center of the joint member 60 in the hole 62.

The distance $L_S$ depends on the depth that the pedal 77 travels when the piano player presses it. In other words, the distance $L_S$ depends on the magnitude of the force applied by the piano player to the pedal 77. When the piano player presses the pedal 77 to the lowest point of its travel, the distance $L_S$ is equal to the longest distance $L_{SMAX}$. The distance $L_{SMAX}$ satisfies the following equation (6):

$$L_{SMAX} \leq D_{HR}+D_{AB}+D_{BC} \quad (6)$$

Because the mathematical formula (6) is satisfied, the hammer felt 48 always hits the piano wire 52C regardless of the amount of the distance $L_S$.

Even when the guided member 73 slides, the whippen 21 and the jack 30 do not slide. The following description is for the case where the guided member 73 slides horizontally in the right-and-left direction with the action 1 being in the ready state. In this case, the pushed-up portion 37 of the hammer butt 36 slides horizontally in the right-and-left direction while it is in contact with the protruding end 33 of the pushing-up portion 32 of the jack 30 from above. FIG. 6 (ii) shows a relative position between the pushed-up portion 37 and the protruding end 33 after the guided member 73 slides to the left by the distance $L_{SMAX}$.

The following description is for the case where the action 1 is in the ready state. In this case, regardless of the amount of the distance $L_S$, the entire length of the pushed-up portion 37 from the right edge 37R to the left edge 37L seen from the piano player's side is in contact with the protruding end 33 from above. The entire length of the pushed-up portion 37 from the right edge 37R to the left edge 371, seen from the piano player's side is always abutted against the protruding end 33, and equally compressed to be thinner. Thus, when seen from the piano player's side, pushed-up portion 37 has no level difference or uneven portion(s) between the right edge 37R and the left edge 37L.

Accordingly, when the action 1 is in the ready state and the guided member 73 slides, the pushed-up portion 37 smoothly slides on the protruding end 33, in this case, the protruding end 33 never slips under any uneven portion. The protruding end 33 never slips out of any uneven portion. The hammer butt 36 never bounds upward without the piano player's intent. In addition, the hammer 44 never rotates backward without the piano player's intent.

When the piano player applies a force to the pedal 77, the hammer head 46 slides to the left by the distance $L_S$. Then, the relative position between the hammer felt 48 and the string 51 varies. The following relation holds between the positions at which the hammer felt 48 hits the piano wires 52A, 52B, and 52C and the distance $L_S$.

When the distance $L_S$ satisfies the following mathematical formula (7), the positions $P_{A2}$, $P_{B2}$, and $P_{C2}$ of the hammer felt 48 hit the piano wires 52A, 52B, and 52C, respectively (see, FIG. 5 (ii)). The position $P_{A2}$ is away to the right from the position $P_{A1}$ by the distance $L_S$. The position $P_{B2}$ is away to the right from position $P_{B1}$ by the distance $L_S$. The position $P_{C2}$ is away to the right from the position $P_{C1}$ by the distance $L_S$ $$0<L_S \leq D_{HR} \quad (7)$$

When the distance LS satisfies the following mathematical formula (8), the positions $P_{B3}$ and $P_{C3}$ of the hammer felt 48 hit the piano wires 52B and 52C, respectively (see, FIG. 5(*iii*)). The hammer felt 48 does not hit the piano wire 52A. The position $P_{B3}$ is away to the right from the position $P_{B1}$ by the distance $L_S$. The position $P_{C3}$ is away to the right from the position $P_{C1}$ by the distance $L_S$.

$$D_{HR}<L_S \leq D_{HR}+D_{AB} \quad (8)$$

When the distance $L_S$ satisfies the following mathematical formula (9), position $P_{C4}$ of the hammer felt 48 hits the piano wire 52C (see, FIG. 5(*iv*)). The hammer felt 48 does not hit the piano wires 52A and 52B. The position. $P_{C4}$ is away to the right from the position $P_{C1}$ by the distance $L_S$.

$$D_{HR}+D_{AB}<L_S \leq L_{SMAX} \quad (9)$$

Depending on the magnitude of the force applied by the piano player to the pedal 77, the number of piano wires hit by the hammer head 46 varies. The positions on the hammer felt 48 at which the piano wires 52A, 52B, and 52C are hit also vary. Therefore, the string 51 makes different sounds when the piano player changes the magnitude of the force applied to the pedal 77.

The piano player can change degrees of loudness or softness of a note by means of changing the magnitude of the force to depress the key 12. This can eliminate a shift pedal provided in a conventional upright piano. In addition, the half-blow rail 19 is not required to rotate backward. The following description is for the case where the pedal 77 is in the released state and the key 12 is in the rest state. In this case, the hammer butt 36 and the jack 30 may be in the following relative relation.

The entire length from the right edge 37R to the left edge 37L of the pushed-up portion 37 of the hammer butt 36 is in contact with the protruding end 33 of the pushing-up portion 32 of the jack 30 from above, seen from the piano player's side. In this state, the right edge 33R of the protruding end 33 is immediately below the right edge 37R of the pushed-up portion 37. In other words, the distance $D_{JBR}$ is equal to zero. The left edge 37L of the pushed-up portion 37 is away to the right from the left edge 33L of the protruding end 33 by the distance $D_{JBL}$. The distance $D_{JBL}$ is equal to or larger than the distance $L_{SMAX}$. In this case, the mathematical formula (4) can be expressed as the following mathematical formula (10):

$$W_J=W_B+D_{JBL} \geq W_B+L_{SMAX} \quad (10).$$

Furthermore, with the mathematical formula (10), it is considered that the following mathematical formula (II) holds. In this case, when the guided member 73 slides to the left by the distance $L_{SMAX}$, the left edge 33L comes immediately beneath the left edge 37L.

$$D_{JBL}=L_{SMAX} \quad (11)$$

Some actions have strings each made up of two piano wires. In such a case, the string 51 in this embodiment can be considered to be composed of two piano wires 52B and 52C. Some actions have strings each made up of a single piano wire. In such a case, the string 51 in this embodiment can be considered to be a single piano wire 52C.

Next, the length $L_B$ of the bridle strap 25 is described. In the following description, a "state C" means a "state in which the pedal 77 is in the released state and the action 1 is in the ready state". A "state D" means a "state in which the pedal 77 is in the activated state and the pedal 77 is pressed to its lowest point of its travel as well as the action 1 is in the ready state". A "state E" means a "moment at which the hammer 44 hits the string 51 and the pedal 77 is in the released state". A "state F" means a "moment at which the hammer 44 hits the string 51 and the pedal 77 is in the activated state, as well as the pedal 77 is pressed to the lowest point of its travel".

First, in the state C, it is assumed that the bridle strap 25 is not present. In this case, a distance between the first joint position $P_1$ and the second contact position $P_4$ corresponds to a first distance $D_1$. In the state D, it is assumed that the bridle strap 25 is not present. In this case, a distance between the first joint position $P_1$ and the second contact position $P_4$ corresponds to a second distance $D_2$.

In the state E, is assumed that the bridle strap 25 is not present. In this case, a distance between the first joint position $P_1$ and the second contact position $P_4$ corresponds to a third distance $D_3$. In the state F, it is assumed that the bridle strap 25 is not present. In this case, a distance between the first joint position $P_1$ and the second contact position $P_4$ corresponds to a fourth distance $D_4$. Depending on the size and shape of the parts forming the action 1, the lengths of the first distance $D_1$, the second distance $D_2$, the third distance $D_3$ and the fourth distance $D_4$ also vary.

The longest distance among the first ($D_1$) through fourth ($D_4$) distances is the distance $D_{MAX}$. If the first length $L_1$ has a length that is equal to or longer than the first distance $D_1$, the front of the key 12 does not fall without the piano player's intent in the state C. If the first length $L_1$ has a length that is equal to or longer than the second distance $D_2$, the front of the key 12 does not fall without the piano player's intent in the state D. If the first length $L_1$ has a length that is equal to or longer than the third distance 1)$_3$, the bridle strap 25 does not pull the first assembly 35 forward in the state E. In addition, the rotation speed of the hammer 44 when it hits the string 51 is not decreased.

If first length $L_1$ has a length equal to or longer than the fourth distance $D_4$, the bridle strap 25 does not pull the first assembly 35 forward in the state F. In addition, the rotation speed of the hammer 44 when it hits the string 51 is not decreased. In other words, the length of the distance $D_{MAX}$ is the minimum length for the first length $L_1$. When the first length $L_1$ is equal to or longer than the distance $D_{MAX}$, the front of the key 12 does not fall without the piano player's intent and the rotation, speed of the hammer 44 when it hits the string 51 is not decreased.

Accordingly, the minimum length $L_{B2}$ for the bridle strap 25 is a total of the length of the distance $D_{MAX}$ and the second length $L_2$. Next, the following description is for the case where the first length $L_1$ is equal to the length obtained by multiplying distance $D_{MAX}$ by a value ranging from 1 to 1.03. In this case, in the state E or F, a slack of the bridle strap 25 is denoted by $S_1$. A slack $S_2$ represents a slack of a bridle strap at the moment when a hammer hits a string in a conventional action in which a half-blow rail rotates. The slack $S_1$ is smaller than the slack $S_2$. Thus, the time $T_2$ is shorter than in the case of conventional upright pianos. As a result, the upright piano permits better playing of repeated notes on the single key 12.

The present inventor compared the following fourth to sixth cases. A "fourth case" means "the case where the first length $L_1$ is equal to the distance $D_{MAX}$". A "fifth case" means "the case where the first length $L_1$ is a length obtained by multiplying the distance $D_{MAX}$ by a value of 1.03". A "sixth case" means "the case where the first length $L_1$ is a length obtained by multiplying the distance $D_{MAX}$ by a value larger than 1.03".

According to the experiments performed by the present inventor, the piano player felt no difference between the fourth and fifth cases in terms of the playing of repeated notes on the single key 12. However, the piano player felt that the sixth case is inferior to the fourth case in terms of the playing of repeated notes on the single key 12. Accordingly, it is preferable that the first length $L_1$ is a length obtained by multiplying the distance $D_{MAX}$ by a value ranging from 1 to 1.03 from the viewpoint of the feeling that the piano player has when he or she plays repeated notes on the single key 12. With the first length $L_1$ having such a range of lengths, the action 1 can be adjusted more easily. In addition, with the first length $L_1$ having such a range of lengths, it becomes easier to address the expansion and compression of the bridle strap 25 due to temperature or humidity.

Some contemporary music compositions require piano players to depress the same key 12 faster and more frequently. In order to meet such requirements and allow more expressive play, the first length $L_1$ is more preferably a length obtained by multiplying the distance $D_{MAX}$ by a value ranging from 1 to 1.025. It is yet more preferable that the first length $L_1$ is a length obtained by multiplying the distance $D_{MAX}$ by a value ranging from 1 to 1.02.

The second joint position $P_2$ may be any position in the first assembly 35. For example, the second joint position $P_2$ may be on the back stop shank 38. The second joint position $P_2$ may be at the boundary between the hammer butt 36 and the back stop shank 38. The second joint position $P_2$ may be on the hammer butt 36. When the second joint position $P_2$ is at a position closer to the rotation center of the hammer butt 36, the difference between the first distance $D_1$ and the third distance $D_3$, the difference between the first distance $D_1$ and the fourth distance $D_4$, the difference between the second distance $D_2$ and the third distance $D_3$, and the difference between the second distance $D_2$ and the fourth distance $D_4$ become smaller.

The following description is for the case where the distance $D_{MAX}$ is equal to the first distance $D_1$ or the second distance $D_2$ in this case, in the state E or F, the bridle strap 25 has a slack. This slack is removed from the bridle strap 25 during the time after the back check 27 releases the back stop 39 and before the bridle strap 25 pulls the first assembly 35. This slack becomes smaller as the difference between the first distance $D_1$ and the third distance $D_3$, the difference between the first distance $D_1$ and the fourth distance $D_4$, the difference between the second distance $D_2$ and the third distance $D_3$, and the difference between the second distance $D_2$ and the fourth distance $D_4$ become smaller. As a result, the time $T_2$ becomes shorter.

Thus, it is preferable that the second joint position $P_2$ is closer to the rotation center of the hammer butt 36 from the viewpoint of providing better playing of the repeated notes on the same key 12. The guided member 73 described in this embodiment slides to the left when the piano player presses the pedal 77. If the guided member 73 slides to the right when the piano player presses the pedal 77, an action having a structure that is like a mirror image of the action 1 in this embodiment.

INDUSTRIAL APPLICABILITY

The action of the upright piano according to the present invention is useful as a structure to improve the performance of the upright piano.

DENOTATION OF REFERENCE NUMERALS

1 action
10 key frame
12 key
14 action rail
15 stepped portion in action rail
18 hammer-rest rail
19 half-blow rail
21 whippen
22 whippen flange
23 heal
24 bridle wire
25 bridle strap
25*a*, 25*b* extra
26 back-check wire
27 back check
30 jack
31 jack tail

32 pushing-up portion
33 protruding end of pushing-up portion
33R right edge of protruding end of pushing-up portion
33L left edge of protruding end of pushing-up portion
35 first assembly
36 hammer butt.
37 pushed-up portion
37R right edge of pushed-up portion
37L left edge of pushed-up portion
38 back stop shank
39 back stop
41 hammer-butt flange
44 hammer
45 hammer shank
46 hammer head
47 hammer moulding
48 hammer felt
48R right edge of hammer felt
48L left edge of hammer felt
51 string
52A, 52B, 52C piano wires
56 support member
57A, 57B arms of support member
60 joint member
61A, 61B arms of joint member
62 hole in arm of joint member
67 guiding member
68 groove in guiding member
68U, 68L inner walls of groove
69 closure portion of groove in guiding member
70 edge portion of groove in guiding member
73 guided member
74 protrusion
75 tension spring
77 pedal
78 base plate
79 trap lever
80 fulcrum
81 pedal rod
$P_{A1}$. $P_{A2}$, $P_{B1}$, $P_{B2}$, $P_{B3}$, $P_{C1}$, $P_{C2}$, $P_{C3}$, $P_{C4}$ positions at which hammer felt hit piano wire(s)
$P_1$ first joint position
$P_2$ second joint position
$P_3$ first contact position
$P_4$ second contact position
$L_B$ length of bridle strap
$L_1$ first length
$L_2$ second length

The invention claimed is:

1. An action of an upright piano comprising:

a key, an action rail extending horizontally in the right-and-left direction from the perspective of a piano player's side, a whippen rotatably supported by the action rail and located on a rear end of the key, a jack rotatably supported by the whippen, a hammer butt to be pushed up by the jack, a hammer supported by the hammer butt, and a string to be hit by the hammer;

a guiding member that extends longitudinally along said action rail and is secured to a surface of said action rail;

a guided member that is slidable along said guiding member, said hammer butt being rotatably supported by a hammer-butt flange, the hammer-butt flange being secured to the guided member, with the guided member disposed between the hammer-butt flange and the guiding member, and with the guiding member disposed between the guided member and the surface of the action ran, wherein said guided member is connected to a pedal rod via a joint member, the pedal rod being connected to a pedal; and an elastic member that biases said guided member in a right or left direction from the perspective of the piano player's side, wherein a force applied by a piano player to said pedal acts on said guided member through said pedal rod and said joint member, the force acting on said guided member having a direction that is opposite to the direction of a bias force applied by said elastic member.

2. The action of claim 1, wherein said jack has a pushing-up portion that pushes up said hammer butt, said hammer butt has a pushed-up portion to be pushed up by said pushing-up portion, a right edge of a protruding end of said pushing-up portion is located immediately beneath a right edge of said pushed-up portion or is away to the right from the right edge of said pushed-up portion from the perspective of the piano player's side, when the piano player applies no force to said key and said pedal, and a left edge of the protruding end of said pushing-up portion is located immediately beneath a left edge of said pushed-up portion or is away to the left from the left edge of said pushed-up portion from the perspective of the piano player's side, when the piano player applies no force to said key and said pedal.

3. The action of claim 1, wherein said jack has a pushing-up portion that pushes up said hammer butt, said hammer butt has a pushed up portion to be pushed up by said pushing-up portion, a right edge of a protruding end of said pushing-up portion is always located immediately beneath a right edge of said pushed-up portion or is always away to the right from the right edge of said pushed-up portion from the perspective of the piano player's side, when the piano player applies no force to said key, and a left edge of the protruding end of said pushing-up portion is always located immediately beneath a left edge of said pushed-up portion or is always away to the left from the left edge of said pushed-up portion from the perspective of the piano player's side, when the piano player applies no force to said key.

4. The action of claim 1, wherein said hammer butt, a back stop shank extending from said hammer butt towards a piano player's side, and a back stop secured to an end of the back stop shank form a first assembly, a bridle wire is projected from said whippen, a bridle strap connects said first assembly and said bridle wire, a position on said bridle wire at which said bridle strap is connected thereto is defined as a first joint position, a position, on a length of said bridle strap contacting with said first assembly, that is closest to said first joint position when said bridle strap has no slack between said first assembly and said bridle wire is defined as a first contact position, and a position in said first assembly contacting the first contact position is defined as a second contact position, a length of said bridle strap between said first joint position and said first contact position is defined as a first length, a distance between said first joint position and said second contact position when no force is applied by the piano player to said key and said pedal is defined as a first distance, provided that it is assumed that said bridle strap is not present, a distance between said first joint position and said second contact position when a distance along which said guided member slides in response to the application of force by the piano player to said pedal is the maximum and no force is applied by the piano player to said key is defined as a second distance, provided that it is assumed that said bridle strap is not present, a distance between said first joint position and said second contact position at a moment when said hammer hits said string and when no force is applied by the piano player to said pedal is defined as a third distance, provided that it is assumed that said bridle strap is not present, a distance between said first joint position and said second contact position at a moment when said hammer hits said string and when a distance along which said guided member slides in response to the application of force by the piano player to said pedal is the maximum is defined as a fourth distance, provided that it is assumed that said bridle strap is not present, and said first length is a length obtained by multiplying the longest distance of said first distance, said second distance, said third distance, and said fourth distance by a value of from 1 to 1.03.

5. The action of claim 1, wherein the guiding member has a C-shaped cross-sectional shape defining a groove with edge portions, wherein the guided member has an H-shaped cross-sectional shape defining a recess, wherein the recess of the guided member engages the edge portions of the groove of the guiding member, and wherein the guided member slides within the groove of the guiding member in the right-and-left direction.

6. The action of claim 5, wherein the guiding member is secured to a front surface of the action rail.

7. The action of claim 6, wherein a front end of the action rail defines a stepped portion that includes the front surface extending as a vertical face in the right-and-left direction and a horizontal surface extending as a horizontal face in the right-and-left direction.

8. An upright piano comprising:

a key;

an action rail extending horizontally in the right-and-left direction from the perspective of a piano player's side;

a whippen rotatably supported by the action rail and located on a rear end of the key;

a jack rotatably supported by the whippen;

a hammer butt that is pushed up by the jack and is rotatably supported by a hammer-butt flange;

a hammer supported by the hammer butt;

a string that is hit by the hammer;

a guiding member that extends longitudinally along the action rail and is secured to a surface of the action rail;

a guided member that is slidable along the guiding member, wherein the hammer-butt flange is secured to the guided member, wherein the guided member is disposed between the hammer-butt flange and the guiding member, and wherein the guiding member is disposed between the guided member and the surface of the action rail;

a pedal rod connected to the guided member via a joint member;

a pedal connected to the pedal rod; and an elastic member that biases the guided member in a right or left direction from the perspective of the piano player's side, wherein a force applied by a piano player to the pedal acts on the guided member through the pedal rod and the joint member, the force acting on the guided member having a direction that is opposite to the direction of a bias force applied by the elastic member.

* * * * *

UNITED STATES PATENT AND TRADEMARK OFFICE

CERTIFICATE OF CORRECTION

PATENT NO. : 8,895,822 B2
APPLICATION NO. : 13/808160
DATED : November 25, 2014
INVENTOR(S) : Yukimitsu Fujii It is certified that error appears in the above-identified patent and that said Letters Patent is hereby corrected as shown below:

On the Title page of the patent, at the item (73) listing the Assignee, replace "Fuji" with --Fujii--.

In the Claims

In claim 1, at column 19, line 67, replace "ran" with --rail--.

Signed and Sealed this
Seventeenth Day of March, 2015

Michelle K. Lee

Michelle K. Lee
*Director of the United States Patent and Trademark Office*